United States Patent [19]

Paskert

[11] Patent Number: 4,960,514

[45] Date of Patent: Oct. 2, 1990

[54] SKIMMING APPARATUS FOR A SWIMMING POOL

[76] Inventor: John E. Paskert, 2582-F Arlington Mill Dr., Arlington, Va. 22206

[21] Appl. No.: 454,964

[22] Filed: Dec. 22, 1989

[51] Int. Cl.[5] ..... E04H 4/14

[52] U.S. Cl. ..... 210/169; 4/507; 4/508

[58] Field of Search ..... 210/405, 169, 416.2; 4/490, 507, 508; 248/206.5, 309.4, 548, 900; 211/96

[56] References Cited

U.S. PATENT DOCUMENTS

| | | | |
|---|---|---|---|
| 2,794,263 | 5/1957 | Cranmer | 248/206.5 |
| 3,244,284 | 4/1966 | Shaffer | 210/169 |
| 3,419,832 | 9/1966 | Baermann | 248/309.4 |
| 4,068,327 | 1/1978 | Heinlein | 210/169 |
| 4,225,436 | 9/1980 | Cseh | 210/169 |
| 4,379,749 | 4/1983 | Roth | 4/490 |
| 4,789,470 | 12/1988 | Wards | 4/490 |
| 4,879,028 | 11/1989 | Gibson | 210/169 |

*Primary Examiner*—Richard V. Fisher
*Assistant Examiner*—Robert A. Simpson
*Attorney, Agent, or Firm*—Walter F. Wessendorf, Jr.

[57] ABSTRACT

Apparatus comprising a base member fixed to a swimming pool wall in operative proximity to a skimmer inlet opening and having a permanent magnet plate embedded therein, and a bracket member having an iron plate embedded therein. An elongated deflector, carried by the bracket member, deflects and guides surface-water-borne dirt, leaves, pollen and other debris via circulating pool water into the skimmer inlet opening. The attractive force exerted by the permanent magnet plate towards the iron plate allows adjustable and fixed relative positioning, vertically, laterally and/or radially, of the bracket member with respect to the base member, and, hence, the deflector. The bracket member and deflector have cooperating means to allow lateral angular positioning of the deflector. Appropriate radial positioning of the deflector creates an inherent force component causing subsurface dirt, leaves, pollen and other debris to rise to the surface to be carried into the skimmer inlet opening. Impact from a person falling upon the deflector, of full-floatation, impact-absorbing material, causes the bracket member to break away without consequent injury to such person and with the bracket member and deflector floating upon the water.

18 Claims, 2 Drawing Sheets

SKIMMING APPARATUS FOR A SWIMMING POOL

BACKGROUND OF THE INVENTION

1. Technical Field

This invention relates to an apparatus for deflecting and guiding dirt, leaves, pollen and other debris into the inlet opening of a swimming pool skimmer.

2. Background

The problem in the art is the need for such an apparatus having a deflector that can be adjustably disposed in fixed relationship, vertically, laterally and/or radially, and in lateral angular relationship, with respect to the inlet opening of a swimming pool skimmer, and with the deflector being removably detached and breaking away upon a small child falling upon the deflector, and without consequent injury to the child.

SUMMARY OF THE INVENTION

The object of the invention is to contribute to the solution of the discussed problem of the art by providing an apparatus having a base member and bracket member carrying a deflector. A permanent magnet plate, embedded within the base member, exerts an attracting force upon an iron plate, embedded within the bracket member, to effect adjustable and fixed mounting vertically, laterally and/or radially of the bracket member with respect to the base member. The bracket member and deflector have cooperating means to further effect adjustable and fixed angular disposition of the deflector relative to the bracket member. A small child falling upon the deflector will cause the deflector to be removably detached and break away without consequent injury to the child

BRIEF DESCRIPTION OF THE DRAWINGS

This object and other objects of the invention should be discerned and appreciated from the detailed description of the preferred embodiment, taken in conjunction with the drawings, wherein like reference numerals refer to similar parts throughout the several drawing figures, in which.

DETAILED DESCRIPTION OF THE PREFERRED EMBODIMENT

Figure 1:
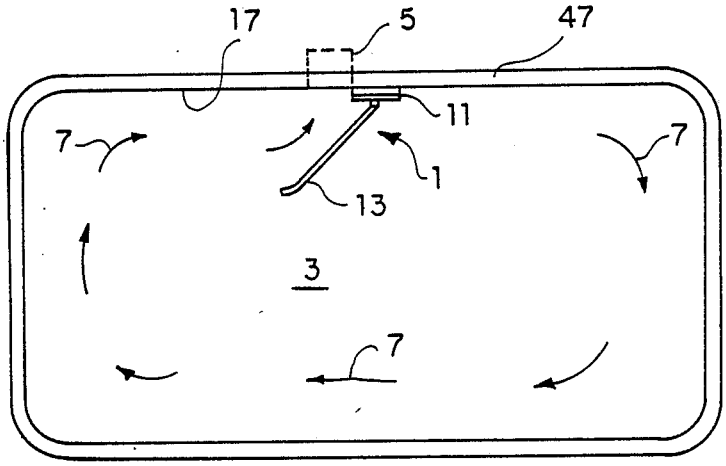
FIG. 1 is a top plan view of a swimming pool.
Figure 2:
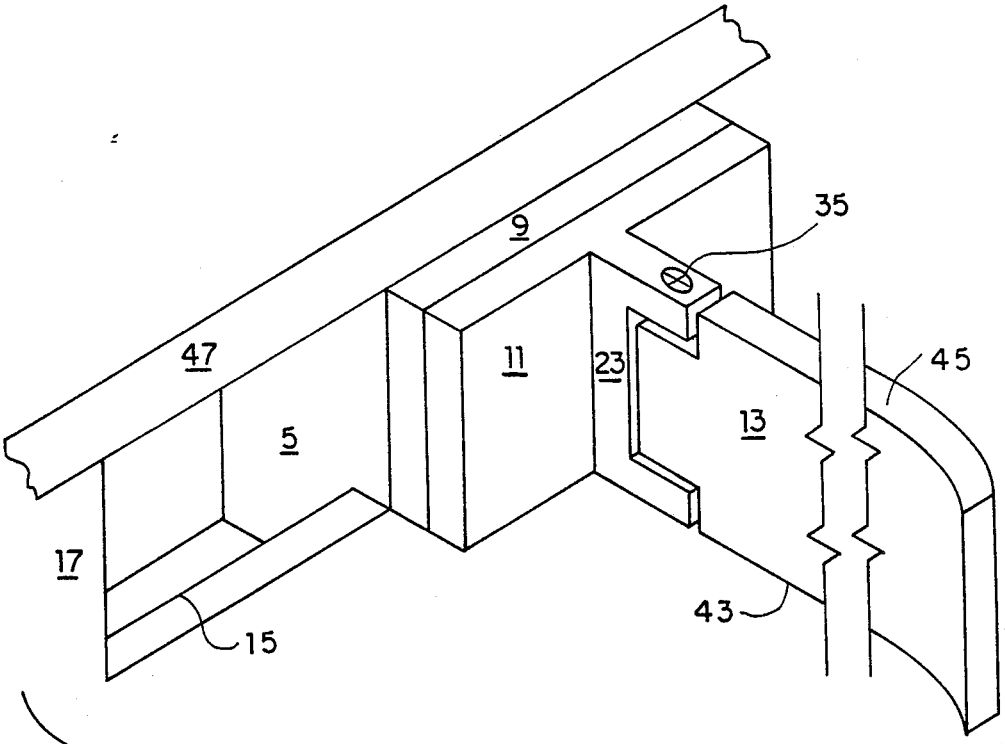
FIG. 2 is a view of the invention showing the base member and bracket member carrying the deflector, fixedly mounted relative to the inlet opening of the swimming pool skimmer.
Figure 3:
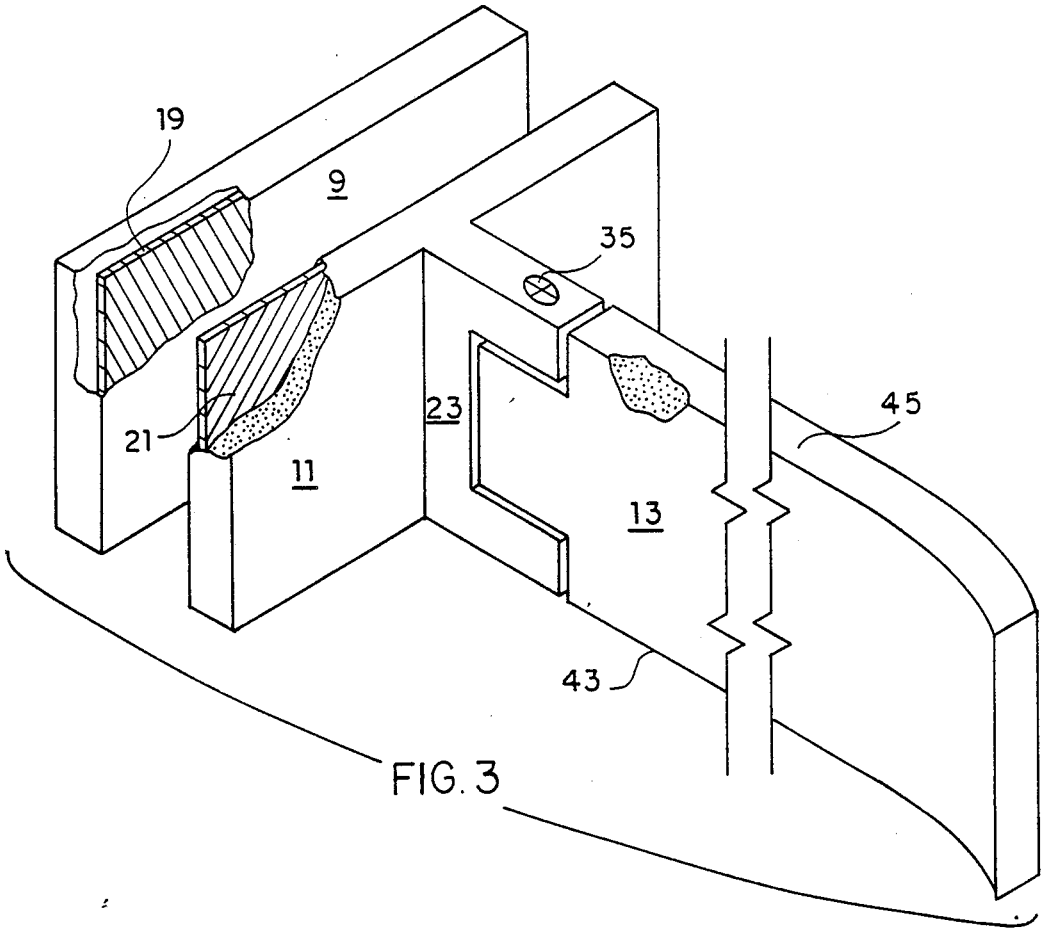
FIG. 3 is a view of the base member, bracket member and deflector, with the base member partly broken away to show the permanent magnet plate embedded therein and the base member partly broken away to show the iron plate embedded therein
Figure 4:
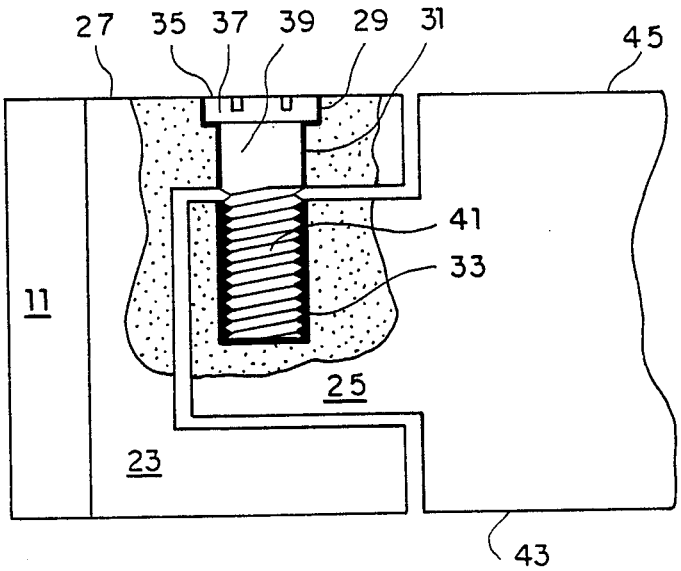
FIG. 4 is a side elevational view showing the feature of lateral angular adjustment of the deflector with respect to the bracket member.

In FIG. 1 of the drawings, reference numeral 1 generally refers to the apparatus, shown in operative position in a swimming pool 3 having a skimmer 5. The directional arrows 7 indicate the flow of surface water from the skimmer return (not shown) to the skimmer 5. The apparatus 1 comprises a base member 9 of suitable plastic material, a bracket member 11 of suitable plastic material and an elongated deflector 13 of suitable full floatation material, such as "Styrofoam" (expanded polystyrene). Base member 9 is fixedly mounted in immediate operative proximity to the inlet opening 15 of the skimmer 5, such as by application of suitable adhesive to either or both of the common mating surfaces of the base member 9 and the wall 17 of the swimming pool 3. Base member 9 has embedded therein a permanent magnet plate 19 and bracket member 11 has embedded therein an iron plate 21. The permanent magnet plate 19 fixedly exerts a force of attraction, in the preferred range of 2 to 5 pounds, with respect to the iron plate 21 embedded within the bracket member 11 to allow adjustable and fixed positioning of the bracket member 11 vertically, laterally and/or radially with respect to the base member 9. Transversely extending from bracket member 11 is a U-shaped element 23 receiving the projecting tongue element 25 of the deflector 13. The upper portion 27 of the U-shaped element 23 has formed therein a counterbore 29 and bearing hole 31 which are aligned with a cylindrical insert 33 of suitable hard plastic material, glued to tongue element 25 or otherwise suitably affixed thereto, having a tapped hole. A thrust bolt 35 has a head 37, shank portion 39 and threaded terminal end portion 41 Disposition of the threaded end portion 41 of bolt 35 in suitably engaged settling relationship with tapped hole 33 of tongue element 25 allows adjustable disposition of the deflector 13 in lateral angular relationship with respect to the U-shaped element 23. Further appropriate tightening engagement of the threaded end portion 41 of thrust bolt 35 will cause the bottom surface of the head 35 to wedgingly engage counterbore 29 to thereby effect removable locking engagement of the deflector 13 with respect to U-shaped element 23 in the predisposed lateral angular relationship of deflector 13 with respect to U-shaped element 23. Discrete adjusted predisposition, by trial and error, of the lateral angular relationship of the deflector 13 with respect to the U-shaped element 23 provides the maximum functional attribute for deflecting and guiding surface-water dirt, leaves, pollen and other debris toward and into the inlet opening 15 of the skimmer 5. Such feature of the adjustable and fixed positioning, vertically, laterally and/or radially, of bracket member 11 relative to base member 9 provides the functional attribute of infinite adjustable positioning of the bracket member 11 and deflector 13 relative to the base member 9. Such described feature of vertical adjustability of the deflector 13 provides the functional attribute of allowing partial to full submersion of the deflector 13 relative to the surface of the water in the swimming pool 3, and further provides ease and simplicity in raising or lowering the deflector vertically to compensate for the water level in the swimming pool 3. Such described feature of radial adjustability of the deflector 13 relative to its longitudinal axis provides the operative attribute for creating an inherent lifting force component to cause dirt, leaves, pollen and other debris, slightly below the surface of the water, to rise to the surface in the immediate proximity to the deflector 13 and be carried by the circulating pool water into the inlet opening 15 of the skimmer 5. Maximizing this described attribute is accomplished by trial and error for such radial disposition of deflector 13 by canting the bottom 43 of deflector 43 toward the direction of the circulating water flowing towards the skimmer 5 and concomitantly canting the top 45 of deflector 13 away from the direction of such water flowing toward skimmer 5. Assuming a toddler, 2 feet tall and weighing 20 pounds, approaches the pool coping 47, bends over from his waist and falls into the pool 3 and upon the deflector: the resulting impact is approximately 20 foot pounds and which is 4 to to 10 times greater than the attractive force that the permanent magnet 19 exerts upon the iron plate 21. The important safety feature of this invention, in such described example, is the fact that not only will the toddler's impact cause the deflector 13 to detach and break away, and float away for reason of the deflector's full floatation material, but also such full floatation material will absorb the toddler's impact without causing any injury to the toddler. And, even if the toddler slips off the pool coping 47, drops 6 inches and hits the deflector, the impact will still be 2 to 5 times the attractive force exerted by the permanent magnet plate 19; and, similarly, the deflector would break away and float away without any consequent injury to the toddler. Thereafter, after first attending to removing the toddler from the pool 3, the bracket member 11 and deflector 13 can be simply and easily repositioned and reattached with respect to the base member 9.

What is claimed is:

1. Skimming apparatus for a swimming pool for maximally deflecting and guiding surface-water-borne dirt, leaves, pollen and other debris in a swimming pool toward and into an inlet opening of a swimming pool skimmer mounted in a wall of the swimming pool, and for causing dirt, leaves, pollen and other debris, submerged in the swimming pool, and, hence, to become surface-water-borne, and to be likewise deflected and guided into the swimming pool skimmer's inlet opening, including base member means, means fixedly mounting said base member means on the swimming pool wall in proximity to the swimming pool skimmer's inlet opening, bracket means for carrying elongated deflector means, said base member means and said bracket means having means both for adjustable disposition of said base member means and said bracket means for infinitely adjustable and translatory positioning of said bracket means and said deflector means vertically, laterally and radially relative to said base member means for operatively disposed said deflector means in immediate proximity to the swimming pool skimmer's inlet opening, for operatively disposing said deflector means in partial to full submersion relative to the surface water in the swimming pool to compensate for the water level of the surface water, and for operatively disposing said deflector means to cause submerged dirt, leaves, pollen and other debris to rise to the surface of the water in the swimming pool to become surface-water-borne and to be deflected and guided into the swimming pool skimmer's inlet opening, and for detachable mounting of said base member means and said bracket means, and said bracket means and said deflector means having their own means for adjustable disposition of said deflector means in lateral and angular relationship relative to said bracket means for maximally deflecting and guiding surface-water-borne dirt, leaves, pollen and other debris toward and into the swimming pool skimmer's inlet opening.

2. Skimming apparatus in accordance with claim 1, wherein said means for adjustable disposition of said base member means and said bracket means are constructed and arranged to cause said bracket means with its said deflector means to detach and break away from said base member means upon a person falling upon said deflector means.

3. Skimming apparatus in accordance with claim 2, wherein said deflector means is constructed and arranged to absorb the impact of a person falling thereupon without causing injury.

4. Skimming apparatus in accordance with claim 3, wherein said deflector means is constructed to impact-absorbing material to absorb the impact of a person falling thereupon without causing injury.

5. Skimming apparatus in accordance with claim 4, wherein said impact-absorbing material of said deflector means is expanded polystyrene.

6. Skimming apparatus in accordance with claim 2, wherein said bracket means with its deflector means are constructed and arranged to float upon the surface of the water in the swimming pool when said bracket means detaches and breaks away from said base member means upon impact of a person falling upon said deflector means.

7. Skimming apparatus in accordance with claim 6, wherein said deflector means is constructed to floatation material.

8. Skimming apparatus in accordance with claim 7, wherein said floatation material of said deflector means is expanded polystyrene.

9. Skimming apparatus in accordance with claim 1, wherein said means for adjustable disposition of said base member means and said bracket means for their detachable mounting, and for infinitely adjustable and translatory positioning of said bracket means with its said deflector means vertically, laterally and radially relative to said base member means, are constructed of magnet means.

10. Skimming apparatus in accordance with claim 9, wherein said magnet means are embedded in sandwiched relationship within said base member means and said bracket means.

11. Skimming apparatus in accordance with claim 1, wherein said means for adjustable disposition of said bracket means and said deflector means for adjustably disposing said deflector means in lateral angular relationship relative to said bracket means comprise a thrust bolt disposed through said bracket means and engaged with a tapped hole in said deflector means.

12. Skimming apparatus in accordance with claim 9, wherein said means for adjustable disposition of said bracket means and said deflector means for adjustably disposing said deflector means in lateral angular relationship relative to said bracket means comprise a thrust bolt disposed through said bracket means and engaged with a tapped hole in said deflector means.

13. Skimming apparatus in accordance with claim 12, wherein said deflector means is constructed and arranged to absorb the impact of a person falling thereupon without causing injury.

14. Skimming apparatus in accordance with claim 13, wherein said deflector means is constructed of impact-absorbing material to absorb the impact of a person falling thereupon without causing injury.

15. Skimming apparatus in accordance with claim 14, wherein said impact-absorbing material of said deflector means is expanded polystyrene.

16. Skimming apparatus in accordance with claim 12, wherein said bracket means with its said deflector means are constructed and arranged to float upon the surface of the water in the swimming pool when said bracket means detaches and breaks away from said base member means upon impact of a person falling upon said deflector means.

17. Skimming apparatus in accordance with claim 16, wherein said deflector means is constructed to floatation material.

18. Skimming apparatus in accordance with claim 17, wherein said floatation material of said deflector means is expanded polystyrene.

* * * * *